US011508317B2

(12) United States Patent
Ha et al.

(10) Patent No.: US 11,508,317 B2
(45) Date of Patent: Nov. 22, 2022

(54) DISPLAY APPARATUS AND DRIVING METHOD THEREOF

(71) Applicant: Samsung Display Co., LTD., Yongin-si (KR)

(72) Inventors: Tae-Seok Ha, Hwaseong-si (KR); Kyoung Soo Kim, Suwon-si (KR); Kyu-Jin Park, Cheonan-si (KR); Seung-Woon Shin, Asan-si (KR); Woon-Rok Jang, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/325,453

(22) Filed: May 20, 2021

(65) Prior Publication Data

US 2022/0068221 A1 Mar. 3, 2022

(30) Foreign Application Priority Data

Aug. 28, 2020 (KR) ..... 10-2020-0109639

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0819* (2013.01); *G09G 2310/061* (2013.01); *G09G 2320/0247* (2013.01)

(58) Field of Classification Search
CPC ..... G09G 2330/042; G09G 3/3648; G09G 3/3688; G09G 3/3677; G09G 2340/0435; G09G 2310/08; G09G 2310/061; G09G 2320/0247; G09G 2320/0233; G09G 2320/0626
See application file for complete search history.

(56) References Cited

U.S. PATENT DOCUMENTS

2016/0078846 A1* 3/2016 Liu ..... G09G 5/006 345/212
2017/0061878 A1* 3/2017 Park ..... G09G 3/3233
2019/0180695 A1* 6/2019 Ha ..... G09G 3/2051
2019/0244579 A1* 8/2019 Oh ..... G09G 3/2022
2019/0253662 A1* 8/2019 Kim ..... H04N 7/0127

FOREIGN PATENT DOCUMENTS

CN 109903725 6/2019
KR 1020190009856 1/2019
KR 1020190020261 2/2019
KR 1020190138718 12/2019
KR 1020200030431 3/2020

* cited by examiner

*Primary Examiner* — Dong Hui Liang
(74) *Attorney, Agent, or Firm* — Cantor Colburn LLP

(57) ABSTRACT

A display device includes a display unit which includes pixels, an emission driver which applies an emission control signal for allowing the pixels to emit light, and a signal controller which receives a data enable signal including an active period and a blank period during which an image signal is inputted and outputs a control signal for controlling the emission driver such that an emission period of the pixels is changed in response to a blank period.

17 Claims, 11 Drawing Sheets

DISPLAY APPARATUS AND DRIVING METHOD THEREOF

This application claims priority to Korean Patent Application No. 10-2020-0109639, filed on Aug. 28, 2020, and all the benefits accruing therefrom under 35 U.S.C. § 119, the content of which in its entirety is herein incorporated by reference.

BACKGROUND

(a) Field

Embodiments of the invention relate to a display device and a driving method thereof.

(b) Description of the Related Art

In general, a display device displays (or refreshes) an image at a constant frame frequency of 60 Hertz (Hz) or higher. However, a frame frequency of rendering by a host processor (e.g., a graphics processing unit ("GPU") or a graphics card) that provides frame data to the display device may not match a refresh frame frequency of the display device. A tearing phenomenon in which a boundary line is generated in an image displayed on the display device may occur due to mismatch between the frame frequency of the host processor and the refresh frame frequency of the display device.

A variable frame mode (e.g., an adaptive-sync mode, a free-sync mode, or a G-sync mode) that provides frame data to a display device at a variable frame frequency has been developed by changing a blank period every frame to prevent such tearing phenomenon. A display device supporting the variable frame mode may prevent the tearing phenomenon by displaying an image in synchronization with a variable frame frequency.

SUMMARY

In a display device operating in a variable frame mode, when an image is displayed at a high frame frequency and then at a low frequency, there is a problem that a difference in luminance may be recognized by a user.

Embodiments have been made in an effort to reduce luminance deviation between frames displayed by a display device when a frame frequency changes.

Embodiments have been made in an effort to improve display quality of a display device.

An embodiment of the invention provides a display device including a display unit which includes pixels, an emission driver which applies an emission control signal such that the pixels emit light, and a signal controller which determines a length of a blank period other than an active period during which an image signal is inputted by receiving a data enable signal from an external graphics source and generates a control signal for controlling the emission driver such that the pixels emit light during an emission period corresponding to the length of the blank period.

In an embodiment, the signal controller may include a counter for determining the length of the blank period of the data enable signal.

In an embodiment, the counter may determine the length of the blank period using a main clock signal that is inputted from the external graphics source.

In an embodiment, the signal controller further includes an emission period adjuster for generating the control signal for controlling a pulse width of the emission control signal depending on a change in the length of the blank period.

In an embodiment, the counter may output information related to the length of the blank period to the emission period adjuster.

In an embodiment, the emission period adjuster may generate the control signal such that the pulse width of the emission control signal is changed depending on the length of the blank period.

In an embodiment, the display device may further include a memory which includes information related to the emission period corresponding to the length of the blank period.

In an embodiment, the emission period adjuster may read the information related to the emission period corresponding to the length of the blank period from the memory, and generates the control signal such that the pulse width of the emission control signal is changed based on the information related to the emission period.

In an embodiment, when the counter determines that the blank period of a current frame is longer than the blank period of a previous frame, the pixels emitting light by an emission control signal having a changed pulse width in a next frame may have a non-emission period that is longer than a non-emission period in the current frame.

In an embodiment, a start of the emission period of the next frame may be delayed or an end thereof may be advanced.

An embodiment of the invention provides a driving method of a display device, and the driving method includes receiving a data enable signal from an external graphics source, determining a length of a blank period other than an active period during which an image signal is inputted from the external graphics source using the data enable signal, and generating a control signal for controlling an emission driver for applying an emission control signal such that pixels included in a display unit emit light during an emission period corresponding to the length of the blank period.

In an embodiment, the determining the length of the blank period may include determining the length of the blank period using a main clock signal that is inputted from the external graphics source.

In an embodiment, the generating the control signal may include generating the control signal such that a pulse width of the emission control signal is changed depending on a change in the length of the blank period.

In an embodiment, the generating the control signal may include reading information related to the emission period from a memory in which the information related to the emission period corresponding to the length of the blank period is stored, and generating the control signal such that the pulse width of the emission control signal is changed based on the information on the emission period.

In an embodiment, the generating control signal may include, when it is determined that the blank period of a current frame is longer than the blank period of a previous frame, generating the control signal such that the pixels emitting light by an emission control signal having a changed pulse width in a next frame to have a non-emission period which is longer than a non-emission period in the current frame.

In an embodiment, a start of the emission period of the next frame may be delayed or an end of the emission period may be advanced.

An embodiment of the invention provides a system including an application processor which outputs data enable signals with different blank periods depending on a variable frame mode, and a display device which includes a display unit including pixels and a signal controller for controlling the display unit such that a period during which the pixels emit light is different depending on the blank periods.

In an embodiment, the signal controller may include a counter which determines lengths of the blank periods, an emission period adjuster which changes a pulse width of an emission control signal for controlling the display unit so that a period during which the pixels emit light is different depending on a change in the lengths of the blank periods, and a memory which includes information related to an emission period depending on the lengths of the blank periods.

In an embodiment, when the counter determines that the blank period of a current frame is longer than the blank period of a previous frame, the pixels emitting light by an emission control signal having a changed pulse width in a next frame may have a non-emission period that is longer than a non-emission period in the current frame.

In an embodiment, a start of the emission period of the next frame may be delayed or an end of the emission period may be advanced.

According to the embodiments, even when the frame frequency changes, there is an effect of reducing the flicker phenomenon of an image displayed by the display device.

According to the embodiments, there is an advantage in that display quality of the display device may be improved.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
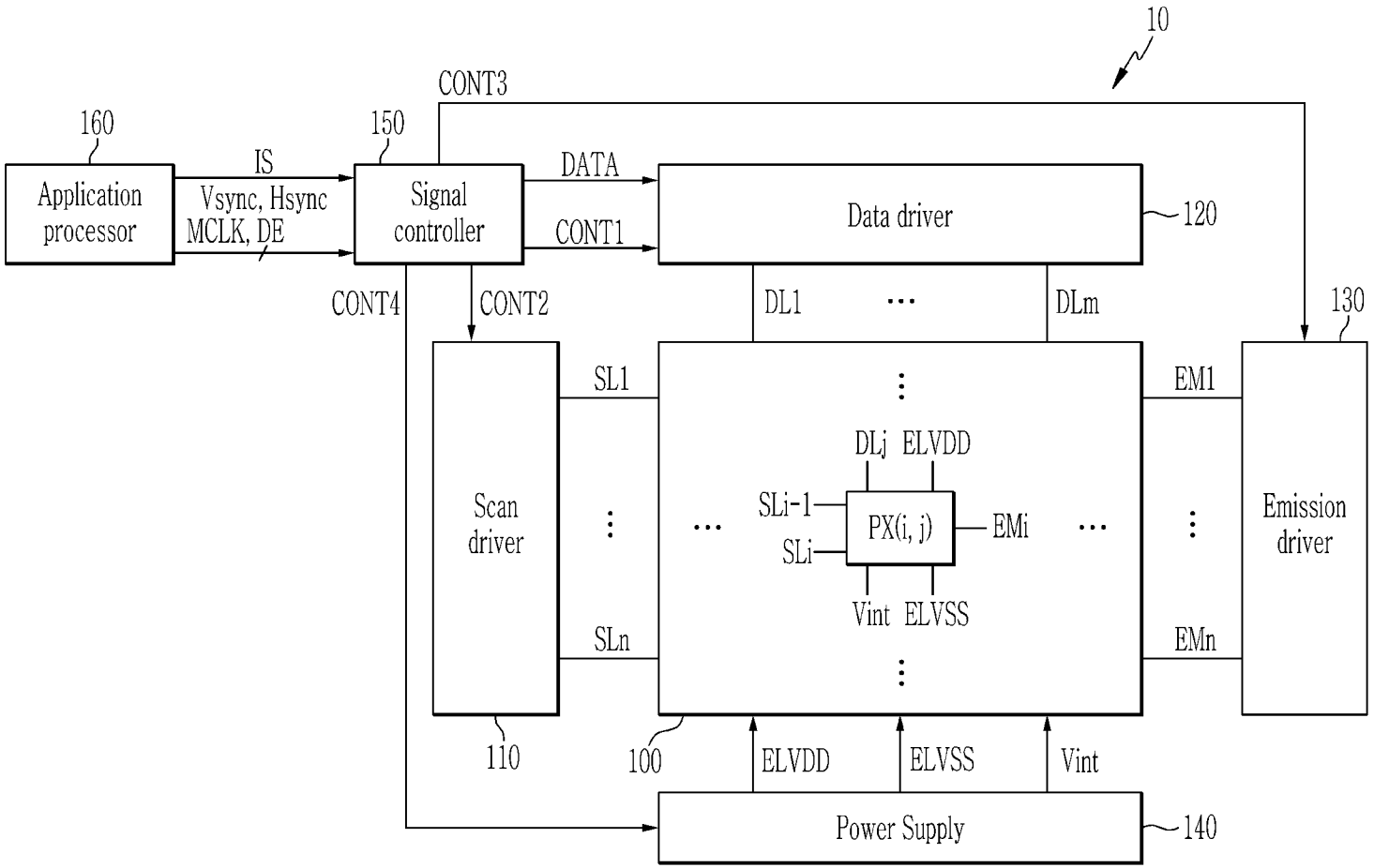
FIG. 1 illustrates a block diagram showing a schematic configuration of a display device.

Embodiments of the invention will be described more fully hereinafter with reference to the accompanying drawings, in which embodiments are shown. As those skilled in the art would realize, the described embodiments may be modified in various different ways, all without departing from the spirit or scope of the invention.

To clearly describe the invention, parts that are irrelevant to the description are omitted, and like numerals refer to like or similar constituent elements throughout the specification.

Further, since sizes and thicknesses of constituent members shown in the accompanying drawings are arbitrarily given for better understanding and ease of description, the invention is not limited to the illustrated sizes and thicknesses. In the drawings, the thicknesses of layers, films, panels, regions, etc., are exaggerated for clarity. In the drawings, for better understanding and ease of description, the thicknesses of some layers and areas are exaggerated.

It will be understood that when an element such as a layer, film, region, or substrate is referred to as being "on" another element, it can be directly on the other element or intervening elements may also be present. In contrast, when an element is referred to as being "directly on" another element, there are no intervening elements present. Further, in the specification, the word "on" or "above" means positioned on or below the object portion, and does not necessarily mean positioned on the upper side of the object portion based on a gravitational direction.

In addition, unless explicitly described to the contrary, the word "comprise" and variations such as "comprises" or "comprising" will be understood to imply the inclusion of stated elements but not the exclusion of any other elements.

Further, in the specification, the phrase "in a plan view" means when an object portion is viewed from above, and the phrase "in a cross-sectional view" means when a cross-section taken by vertically cutting an object portion is viewed from the side.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

FIG. 1 illustrates a block diagram showing an embodiment of a schematic configuration of a display device 10. The display device 10 includes a display unit 100, a scan driver 110, a data driver 120, an emission driver 130, a power supply 140, and a signal controller 150. In an embodiment, the display device 10 may be connected to an application processor 160 or may include an application processor 160. The constituent elements illustrated in FIG. 1 are not essential for implementing a display device, so the display device described in the invention may include more or less constituent elements than the foregoing listed constituent elements.

The display unit 100 includes a plurality of pixels PX connected to corresponding scan lines of a plurality of scan lines SL1 to SLn, corresponding data lines of a plurality of data lines DL1 to DLm, and corresponding emission control lines of a plurality of emission control lines EM1 to EMn. Here, m and n are natural numbers. Each of the pixels PX emits light depending on a data signal transferred to the corresponding pixel PX, so that the display unit 100 may display an image.

The scan lines SL1 to SLn extend substantially in a row direction to be substantially parallel to each other. The emission control lines SL1 to SLn also extend substantially in the row direction to be substantially parallel to each other. The data lines DL1 to DLm extend substantially in a column direction to be substantially parallel to each other.

Each of the plurality of pixels PX receives power supply voltages ELVDD and ELVSS and an initialization voltage Vint from the power supply 140.

Herein, supply wires of the scan lines SLi−1 and SLi, the emission control line EMi, and the initialization voltage Vint may be wires in a same layer, and supply wires of the data line DLi and the power supply voltages ELVDD and ELVSS may be wires in a same layer. The supply wires of the scan lines SLi−1 and SLi, the emission control line EMi, the initialization voltage Vint, the data line DLi, and the power supply voltages ELVDD and ELVSS may include a same material or different materials, and may be disposed in a same layer or different layers on a substrate.

The scan driver 110 is connected to the display unit 100 through the scan lines SL1 to SLn. The scan driver 110 generates a plurality of scan signals depending on a control signal CONT2 to sequentially transfer the scan signals respectively to corresponding scan lines among the scan lines SL1 to SLn. The control signal CONT2 is an operation control signal of the scan driver 110 generated and transferred by the signal controller 150. The scan driver 110 sequentially drives a plurality of scan lines by sequentially supplying scan signals of an ON voltage or an OFF voltage under control of the signal controller 150. The scan driver 110 may be disposed only at one side of the display unit 100 or at opposite sides of the display unit 100 depending on a driving method.

The data driver 120 is connected to each pixel PX of the display unit 100 through the data lines DL1 to DLm. The data driver 120 receives an image data signal DATA, and transmits a data signal corresponding to a corresponding one of the data lines DL1 to DLm depending on a control signal CONT1. The control signal CONT1 is an operation control signal of the data driver 120 generated and transferred by the signal controller 150.

The data driver 120 selects a gray voltage depending on the image data signal DATA and transfers the selected gray voltage to the data lines as a data signal. In an embodiment, the data driver 120 samples and holds the image data signal DATA inputted depending on the control signal CONT1, and transfers a plurality of data signals to the data lines DL1 to DLm, for example. The data driver 120 may apply a data signal having a predetermined voltage range to the data lines DL1 to DLm while an enable-level scan signal is applied.

The emission driver 130 generates a plurality of emission control signals depending on a control signal CONT3. The control signal CONT3 may include an emission start signal, emission clock signals switching to an enable level at different times, a holding control signal, and the like. The emission start signal is a signal for generating a first emission control signal for displaying an image of one frame. The emission clock signals included in the control signal CONT3 are synchronization signals for applying the emission control signals to the emission control lines EM1 to EMn. The holding control signal is a signal that controls the emission driver 130 to continuously output an emission signal during low frequency driving. The generation of the control signal CONT3 by the signal controller 150 will be described in detail with reference to FIG. 6 below.

The signal controller 150 receives an image signal IS that is inputted from the application processor (also referred to as an external graphics source) 160 (e.g., a graphics processing unit ("GPU") or a graphics card) and an input control signal for controlling the display thereof. The image signal IS may include luminance information that is divided by grays of each pixel PX of the display unit 100.

The input control signal transferred to the signal controller 150 includes a vertical synchronization signal Vsync, a horizontal synchronizing signal Hsync, a main clock signal MCLK, and a data enable signal DE.

The signal controller 150 generates the control signals CONT1, CONT2, CONT3, and CONT4 and the image data signal DATA depending on the image signal IS, the horizontal synchronizing signal Hsync, the vertical synchronization signal Vsync, the main clock signal MCLK, the data enable signal DE, and the like. The signal controller 150 processes the image signal IS appropriately in accordance with operating conditions of the display unit 100 and the data driver 120 based on the input image signal IS and the input control signal. Specifically, the signal controller 150 may generate the image data signal DATA through an image processing process such as gamma correction and luminance compensation on the image signal IS.

In an embodiment, the signal controller 150 generates the control signal CONT1 for controlling an operation of the data driver 120 and transfers the control signal CONT1 to the data driver 120 together with the image data signal DATA that has been subjected to an image processing process, for example. In addition, the signal controller 150 transfers the control signal CONT2 for controlling an operation of the scan driver 110 to the scan driver 110. The signal controller 150 may also drive the emission driver 130 by transferring the control signal CONT3 to the emission driver 130.

In addition, the signal controller 150 may control driving of the power supply 140. The power supply 140 may supply power supply voltages ELVDD and ELVSS for driving each of the pixels PX, and an initialization voltage Vint. In an embodiment, the signal controller 150 may drive the power supply 140 by transferring the control signal CONT4 to the power supply 140, for example. The power supply 140 may be connected to a voltage supply line formed in the display unit 100.

The signal controller 150 may support a variable frame mode in which an image is displayed (or refreshed) at a variable frame frequency as the application processor 160 supplies image signal (also referred to as input image data) IS to the display device 10 at the variable frame frequency by changing a blank period for each frame period, and the signal controller 150 supplies the output frame data DATA to the data driver 120 in synchronization with the variable frame frequency. The variable frame mode may be also referred to as an adaptive-sync mode, a free-sync mode, a G-Sync mode, or the like.

A cycle or frequency of rendering of the application processor 160 (e.g., a GPU or a graphics card) may not be constant (especially when rendering game image data), and in the variable frame mode, the application processor 160 may supply the input image data IS, i.e., frame data, to the display device 10 in synchronization with a non-uniform period or frequency of such rendering. Each frame period includes an active period during which a data enable signal DE is toggled and a blank period during which the data enable signal DE is not toggled, and the application processor 160 may vary a length of the blank period to supply frame data to the display device 10 at a variable frame frequency.

Next, a pixel PX included in the display device 10 will be described with reference to FIG. 2.

Figure 2:
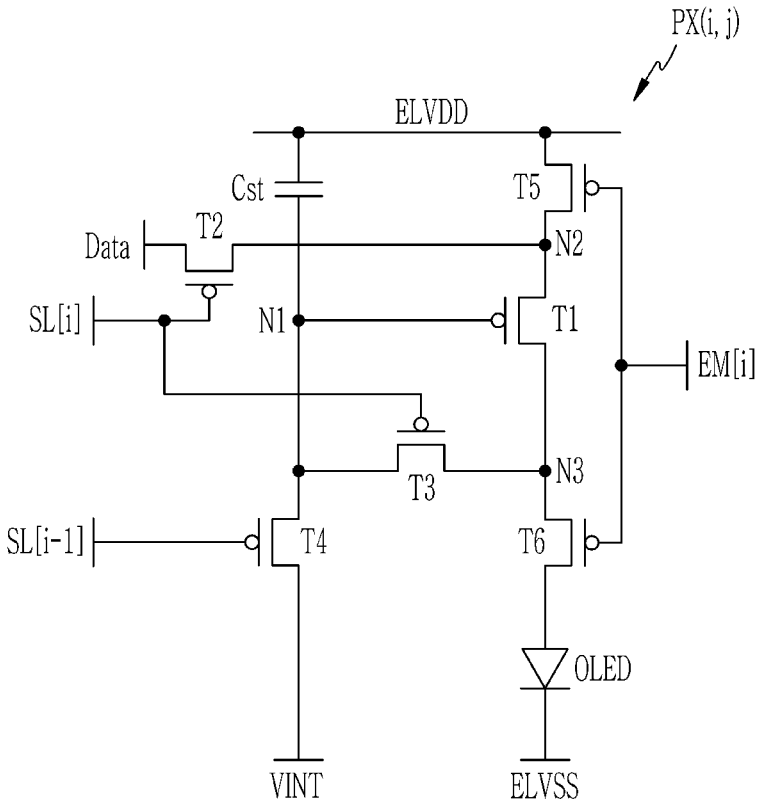
FIG. 2 illustrates a circuit diagram showing an embodiment of a pixel in the display device of FIG. 1.

FIG. 2 illustrates a circuit diagram showing an embodiment of a pixel in the display device of FIG. 1.

The pixel PX includes a plurality of transistors T1, T2, T3, T4, T5, and T6, a capacitor Cst, and an organic light emitting diode OLED which are selectively connected to each of a scan line SLi to which a scan signal SL[i] is supplied, a scan line SLi−1 to which a scan signal SL[i−1] is supplied, an emission control line EMi to which an emission control signal EM[i] is supplied, a supply wire of an initialization voltage Vint, a data line DLj to which a data signal Data is supplied, and supply wires of power supply voltages ELVDD and ELVSS. Here, i and j may be natural numbers.

A gate of the first transistor T1 is connected to a drain of the third transistor T3, the drain of the fourth transistor T4, and a first electrode of the capacitor Cst at a first node N1, a source of the first transistor T1 is connected to a drain of the second transistor T2 and a drain of the fifth transistor T5, and a drain of the first transistor T1 is connected to a source of the third transistor T3 and a source of the sixth transistor T6.

A gate of the second transistor T2 is connected to the scan line SLi, a source of the second transistor T2 is connected to the data line DLj, and a drain of the second transistor T2 is connected to the source of the first transistor T1 at a second node N2.

A gate of the third transistor T3 is connected to the scan line SLi, a source of the third transistor T3 is connected to the drain of the first transistor T1 at a third node N3, and the drain of the third transistor T3 is connected to the gate of the first transistor T1 at the first node N1.

A gate of the fourth transistor T4 is connected to a scan line SLi−1, a source of the fourth transistor T4 is connected to the initialization voltage line to which the initialization voltage Vint is applied, and a drain of the fourth transistor T4 is connected to the gate of the first transistor T1 at the first node N1.

A gate of the fifth transistor T5 is connected to the emission control line EMi, a source of the fifth transistor T5 is connected to the supply wire to which the power voltage ELVDD is applied, and a drain of the fifth transistor T5 is connected to the source of the first transistor T1 at the second node N2.

A gate of the sixth transistor T6 is connected to the emission control line EMi, a source of the sixth transistor T6 is connected to the drain of the first transistor T1 at the third node N3, and a drain of the sixth transistor T6 is connected to the first electrode of the organic light emitting diode OLED. The first transistor T1 is connected to the organic light emitting diode OLED through the sixth transistor T6.

The capacitor Cst has a first electrode that is connected to the gate and the drain of the third transistor T3 at the first node N1, and a second electrode that is connected to the supply wire of the power supply voltage ELVDD.

The organic light emitting diode OLED has a first electrode, a second electrode disposed on the first electrode, and an organic emission layer disposed between the first electrode and the second electrode. The first electrode of the organic light emitting diode OLED is connected to the drain of the sixth transistor T6, and the second electrode thereof is connected to the supply wire of the power supply voltage ELVSS.

In the above, it has been described that the pixel PX includes six transistors T1, T2, T3, T4, T5, and T6 and one capacitor Cst. However, the invention is not limited thereto, and the pixel PX may further include a transistor connected between an anode of the organic light emitting diode OLED and a supply line of the initialization voltage Vint, and including a gate connected to the scan line SLi−1.

An operation of a display device having the pixel having the above-described structure will be described with reference to FIG. 3 to FIG. 5.

Figure 3:
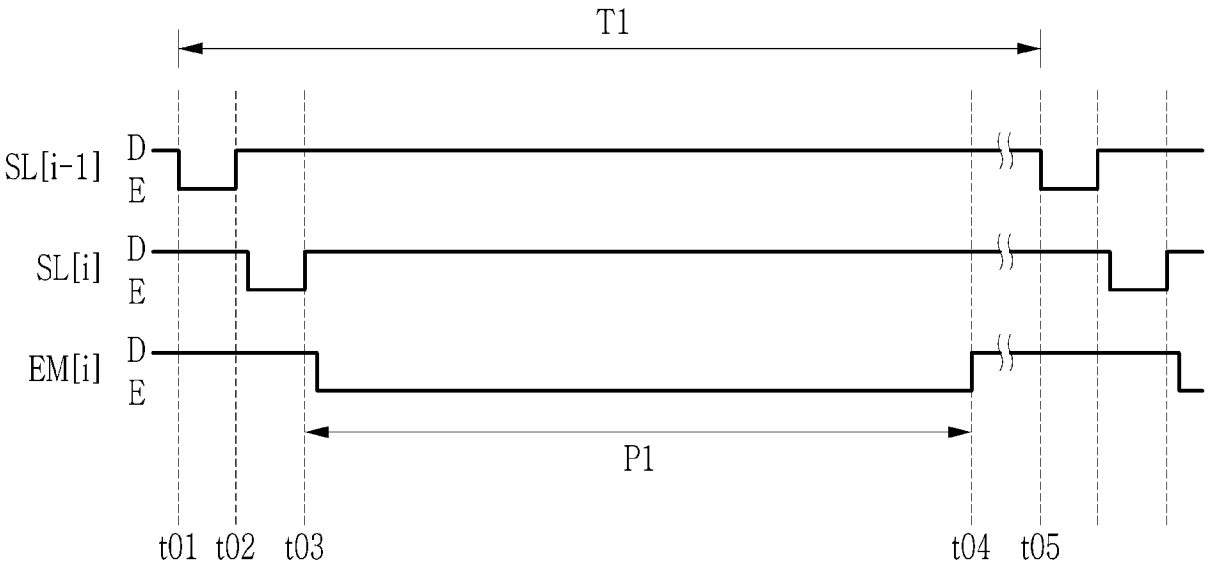
FIG. 3 to FIG. 5 illustrate timing diagrams schematically showing driving timings of scan signals and emission control signals.
Figure 4:
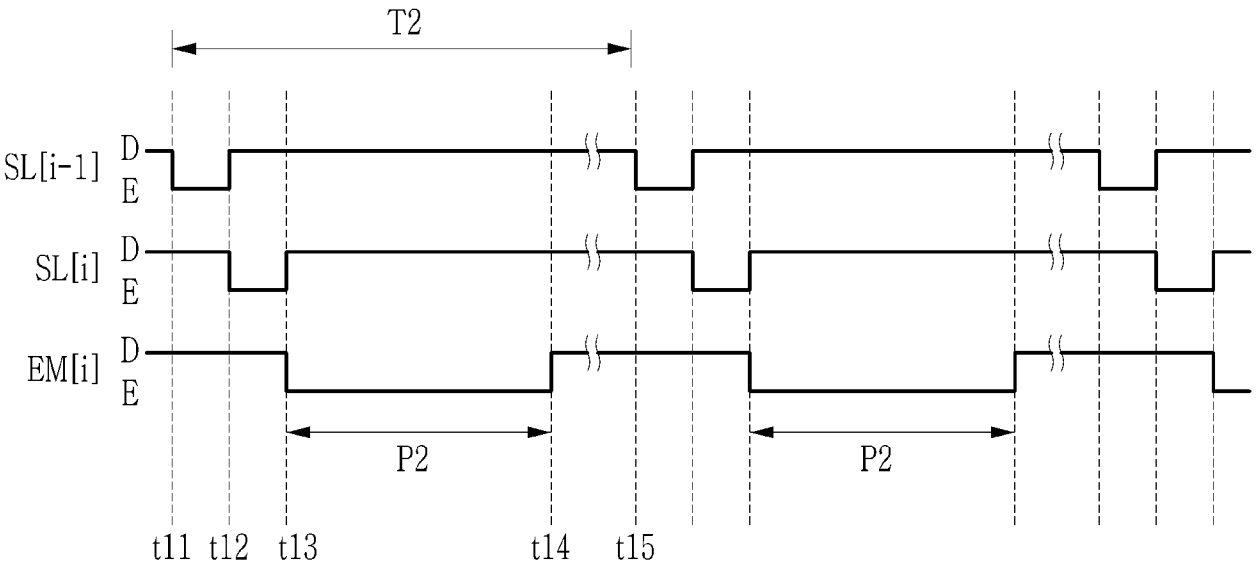
Figure 5:
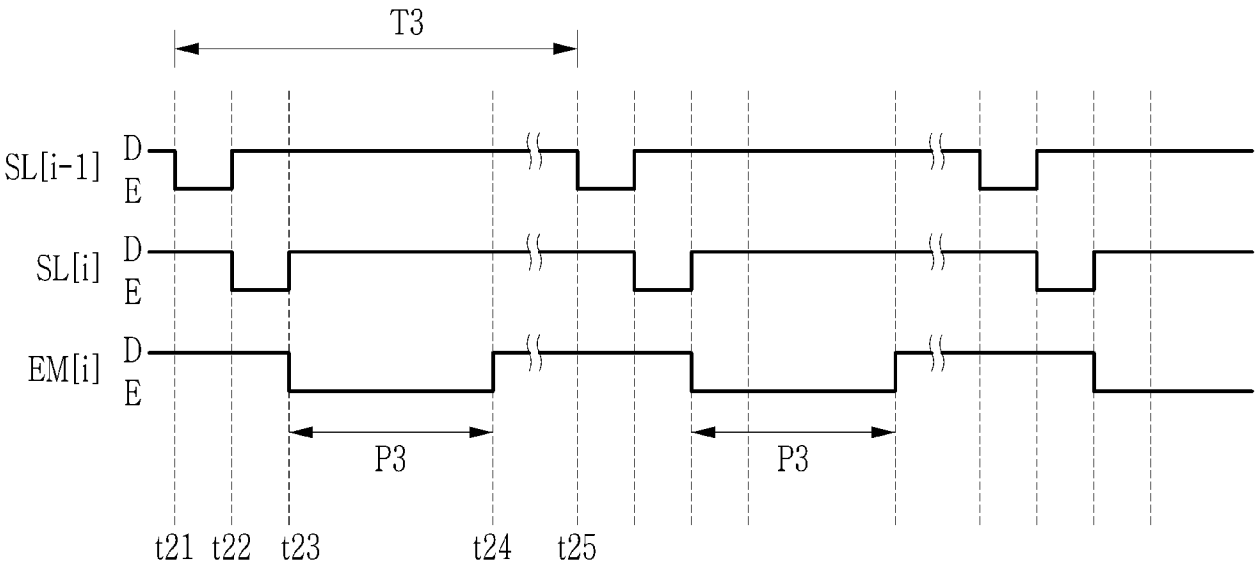

FIG. 3 to FIG. 5 illustrate timing diagrams schematically showing driving timings of scan signals and emission control signals.

A current scan line to be driven is an $i^{th}$ scan line, a scan signal applied to the $i^{th}$ scan line SLi is SL[i], a scan line driven before the current scan line is an $(i-1)^{th}$ scan line, and a scan signal applied to the $(i-1)^{th}$ scan line SLi−1 is SL[i−1].

FIG. 3 illustrates a timing diagram schematically showing driving timings of the scan signals SL[i−1] and SL[i] and the emission control signal EM[i] when a frame frequency is f1. Herein, T1, which is a time span from t01 to t05, is one frame period, and P1, which is a time span from t03 to t04, is an emission time span within one frame period.

As illustrated in FIG. 3, in a period from t01 to t02, the previous scan signal SL[i−1] has an enable level E, and the current scan signal SL[i] and the emission control signal EM[i] has a disable level D. The fourth transistor T4 is turned on by the previous scan signal SL[i−1] of the enable level E, and the first to third transistors T1, T2, and T3 and the fifth and sixth transistors T5 and T6 are turned off by the current scan signal SL[i] of the disable level D and the emission control signal EM[i]. Accordingly, a voltage stored in the capacitor Cst, that is, a gate voltage of the first transistor T1, is initialized.

Thereafter, in a period from t02 to t03, the previous scan signal SL[i−1] and the emission control signal EM[i] have the disable level D, and the current scan signal SL[i] has the enable level E. The fourth to sixth transistors T4, T5, and T6 are turned off by the previous scan signal SL[i−1] and the emission control signal EM[i] of the disable level D, and the second and third transistors T2 and T3 are turned on by the current scan signal SL[i] of the enable level E, so that the first transistor T1 is connected as a diode. Nodes N1 and N3 are connected through the third transistor T3, and the data voltage VDATA applied to a corresponding $i^{th}$ data line is inputted into a source of the first transistor T1. Since the first transistor T1 is connected as a diode, the gate voltage of the first transistor T1 is VDATA−VTH(T1), and the gate voltage is stored in the capacitor Cst. Herein, VTH(T1) is a threshold voltage of the first transistor T1.

Next, in a period from t03 to t04, the previous scan signal SL[i−1] and the current scan signal SL[i] have the disable level D, and the period from t03 to t04 is the emission period P1 in which the light emission control signal EM[i] has the enable level E. The second to fourth transistors T2, T3, and T4 are turned off by the previous scan signal SL[i−1] and the current scan signal SL[i] of the disable level D, and the fifth and sixth transistors T5 and T6 are turned on by the emission control signal EM[i] of the enable level E. A driving current is generated depending on a voltage difference between a voltage of the gate electrode of the first transistor T1 and the power supply voltage ELVDD, and is supplied to the organic light emitting diode OLED through the sixth transistor T6, to allow the organic light emitting diode to emit light. During the emission period P1, the gate source voltage Vgs of the first transistor T1 is maintained at VDATA+Vth(T1)−ELVDD by the capacitor Cst, and the drive current is proportional to $(VDATA-ELVDD)^2$. Accordingly, the driving current is determined regardless of the threshold voltage Vth(T1) of the first transistor T1.

Finally, a period from t04 to t05 is a period after the end of the emission period until the start of the next frame, and the previous scan signal SL[i−1], the current scan signal SL[i], and the emission control signal EM[i] all have the disable level D. Accordingly, all of the first to sixth transistors T1, T2, T3, T4, T5, and T6 are turned off. Herein, it has been described that t04 is different from t05, but t04 may be the same as t05, and in this case, as soon as the emission period P1 ends, a scan signal for a next frame may start.

A new frame starts from t05, and the above-described sequence from t01 to t05 may be repeated.

FIG. 4 illustrates a timing diagram schematically showing driving timings of the scan signals SL[i−1] and SL[i] and the emission control signal EM[i] when a frame frequency is f2. Herein, T2, which is a time span from t11 to t15, is one frame period, and P2, which is a time span from t13 to t14, is an emission time span within one frame period.

An operation of a period from t11 to t12 may be similar to the operation of the period from t01 to t02 described above. An operation of a period from t12 to t13 may be similar to the operation of the period from t02 to t03 described above. An operation of a period from t13 to t14 may be similar to the operation of the period from t03 to t04 described above. An operation of a period from t14 to t15 may be similar to the operation of the period from t04 to t05 described above.

FIG. 5 illustrates a timing diagram schematically showing driving timings of the scan signals SL[i−1] and SL[i] and the emission control signal EM[i] when a frame frequency is f3. Herein, T3, which is a time span from t21 to t25, is one frame period, and P3, which is a time span from t23 to t24, is an emission time span.

An operation of a period from t21 to t22 may be similar to the operation of the period from t01 to t02 described above. An operation of a period from t22 to t23 may be similar to the operation of the period from t02 to t03 described above. An operation of a period from t23 to t24 may be similar to the operation of the period from t03 to t04 described above. An operation of a period from t24 to t25 may be similar to the operation of the period from t04 to t05 described above.

The timing diagrams shown in FIG. 3 to FIG. 5 will be compared and described. The frame frequency may satisfy f1<f2<f3. In this case, one frame period is T1>T2>T3, and the emission period is P1>P2>P3. As the frame frequency becomes higher, more time is desired to write data during the same time span. Accordingly, as the frame frequency becomes higher, the emission period becomes shorter and the luminance becomes lower. For this reason, when the frame frequency of successive frames rapidly changes, for example, when an image is displayed at a high frame frequency by adaptive sync and then at a lower frequency, there is a problem that a difference in luminance may be recognized by a user.

Figure 6:
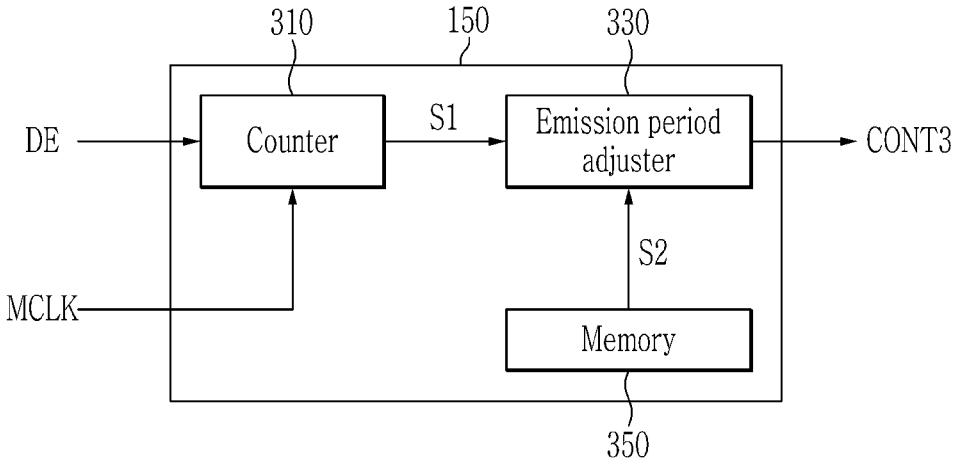
FIG. 6 illustrates a block diagram schematically showing an embodiment of some constituent elements of a signal controller.

FIG. 6 illustrates a block diagram schematically showing an embodiment of some constituent elements of a signal controller.

The signal controller 150 may include a counter 310, an emission period adjuster (also referred to as an emission span adjuster) 330, and a memory 350.

The counter 310 may receive the data enable signal DE and the main clock signal MCLK from the application processor 160 (refer to FIG. 1). The counter 310 may receive the data enable signal DE of which an input frequency is changed every frame period from the application processor 160.

When the data enable signal DE is received from the application processor 160, the counter 310 may determine a length of a blank period after the data enable signal DE reaches the disable level D and until the data enable signal DE is toggled. In addition, the counter 310 may detect a frame frequency from a time span between active periods of the data enable signal DE. In this case, the counter 310 may determine the length of the blank period by counting the clock signal CLK during the blank period of the data enable signal DE, but the invention is not limited thereto. The clock signal CLK may be a main clock signal MCLK supplied from the application processor 160, may be an internal clock signal generated based on the main clock signal MCLK, or may be a clock signal generated by an oscillator included in the signal controller 150, but the invention is not limited thereto.

After determining the length of the blank period of the data enable signal DE, the counter 310 outputs a first signal S1 to the emission period adjuster 330. The first signal S1 may include information related to the frame frequency and information related to the length of the blank period of the data enable signal DE.

The emission period adjuster 330 may receive the first signal S1 from the counter 310, and may determine a non-emission period of a next frame depending on the received first signal S1. The emission period adjuster 330 may determine an emission period of the pixel PX based on a second signal S2 received from the memory 350.

The emission period adjuster 330 may output a control signal CONT3 to the emission driver 130 (refer to FIG. 1) such that the emission control signal has the disable level D during the determined non-emission period. In this case, the emission period adjuster 330 may output a control signal CONT3 that causes the non-emission period of the pixel PX in a next frame to be the same as the non-emission period of a previous frame. The non-emission period in which the emission control signal EM outputted from the emission driver 130 has the disable level D may be adjusted by the control signal CONT3.

That is, the emission period adjuster 330 may vary the emission period of the pixel PX depending on a change of the blank period of the data enable signal DE, and may allow the non-emission period of the pixel to be constant in each frame. Accordingly, the emission period adjuster 330 may adjust luminance of an image by controlling a pulse width of the emission control signal EM in response to luminance that fluctuates depending on the change of the blank period, thereby preventing a user of the display device 10 from visually recognizing flicker between frames.

A time for counting the blank period of the frame period after the frame frequency of the data enable signal DE is changed is desired, until the blank period of the changed frame period ends, in order for the counter 310 to check the blank period of the data enable signal DE. Accordingly, the emission period adjuster 330 may adjust the emission period of the pixel PX after latency of at least one frame exists, after the frame frequency is changed instead of adjusting the emission period of the pixel PX from a first frame changed after the frame frequency is changed.

The memory 350 may store information related to an appropriate emission period depending on a change in the frame frequency of the data enable signal DE. The memory 350 may store information related to an appropriate emission period corresponding to the blank period of the data enable signal DE counted by the counter 310. The memory 350 may also store information related to an emission period depending on values of frame frequencies that change between two frames. In an embodiment, the memory 350 separates and stores information related to an emission period in the case of changing from about 240 hertz (Hz) to about 60 Hz and information related to an emission period in the case of changing from about 120 Hz to about 60 Hz, for example. The information may be stored in the memory 350 in the form of a plurality of lookup tables ("LUTs"). The length of the blank period may be divided into a plurality of periods, and information related to the emission period corresponding to each of the periods may be stored in an LUT. In an embodiment, assuming that a blank count corresponds to the frame frequency, information related to an emission period when the frame frequency changes to f2 may be stored in an LUT corresponding to a period during which the frame frequency is f2, for example. In an embodiment, information related to an emission period depending on a case where the frame frequency changes from f3 to f2, a case where the frame frequency changes from f1 to f2, and the like may be stored in the LUT corresponding to the period during which the frame frequency is f2, for example.

The memory 350 may output the second signal S2 to the emission period adjuster 330, and the second signal S2 may include information related to an emission period depending on a change in the length of the blank period and information related to an emission period according to a change in the frame frequency.

Figure 7:
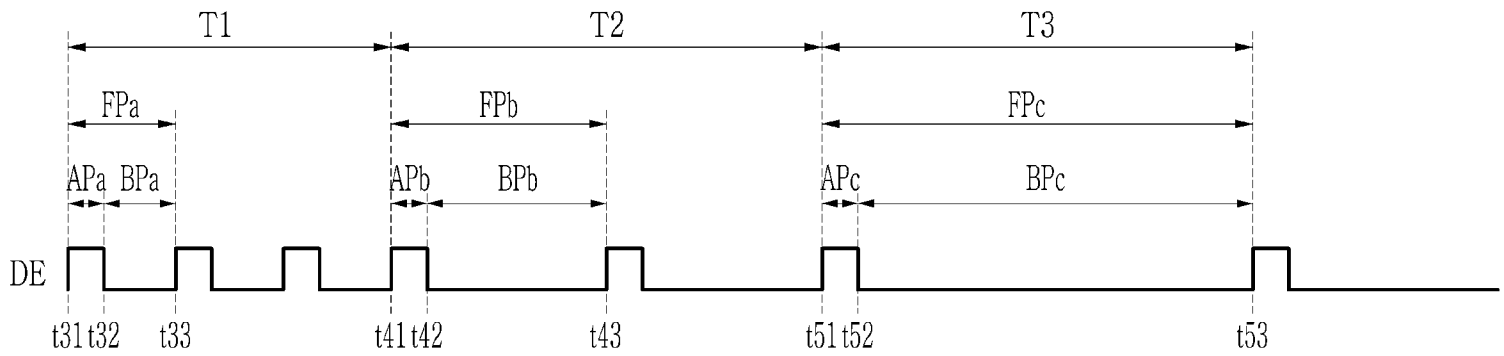
FIG. 7 illustrates a timing diagram schematically showing an embodiment of a change in a data enable signal depending on a frequency during adaptive sync driving.

FIG. 7 illustrates a timing diagram schematically showing a change in a data enable signal depending on a frequency during adaptive sync driving.

When image data is input at a constant frame frequency, each frame period includes an active period and a blank period having a constant length of time. When image data is inputted at a variable frame frequency, each frame period includes an active period having a constant time length regardless of the frame frequency and a blank period having a time length corresponding to the variable frame frequency.

As illustrated in FIG. 7, within a period T1, an active period APa (t31 to t32) and a blank period BPa (t32 to t33) of the signal DE are included in one frame period FPa. Within a time span T2, an active period APb (t41 to t42) and a blank period BPb (t42 to t43) of the data enable signal DE are included in one frame period FPb. In addition, within a time span T3, an active period APc (t51 to t52) and a blank period BPc (t52 to t53) of the data enable signal DE are included in one frame period FPc. Herein, T1 is a time span during which the frame frequency is f1, T2 is a time span during which the frame frequency is f2, and T3 is a time span during which the frame frequency is f3. Herein, f1, f2, and f3 may satisfy f1>f2>f3. That is, as the frame frequency becomes slower, the blank period of the data enable signal DE becomes longer. In an embodiment, when f1 is about 240 Hz, f2 is about 120 Hz, and f3 is about 60 Hz, the length of the blank period may satisfy BPa<BPb<BPc, for example.

As such, when the data enable signal DE is inputted at a variable frame frequency, the blank period is variable, and thus, unlike the case of displaying an image at a constant frame frequency, a difference in the length of the blank period may occur for each frame. A time span during which the pixel PX emits light may also be changed depending on the difference in the length of the blank period, and when a time span during which the pixels PX emit light is different for each frame, a flicker phenomenon may occur, resulting in deterioration of image quality.

An operation of the signal controller 150 for adjusting the length of the emission period between frames will be described with reference to FIG. 8A to FIG. 8C below.

Figure 8A:
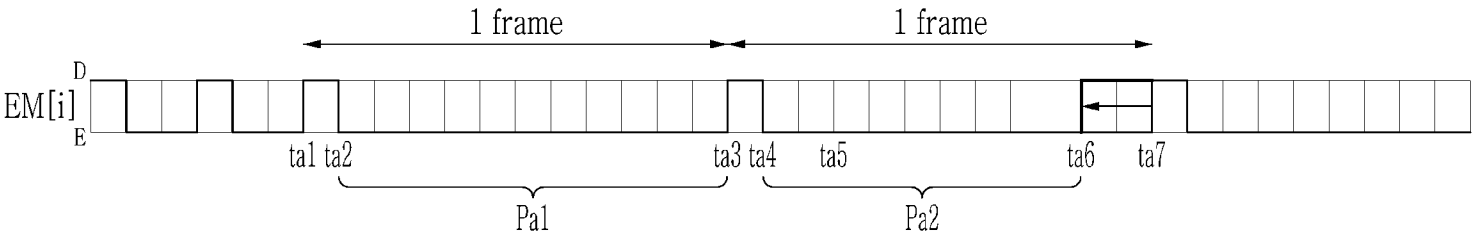
FIG. 8A to FIG. 8C illustrate a timing diagram showing an embodiment of an emission control signal applied to an $i^{th}$ emission control line depending on a change in a data enable signal.
Figure 8B:
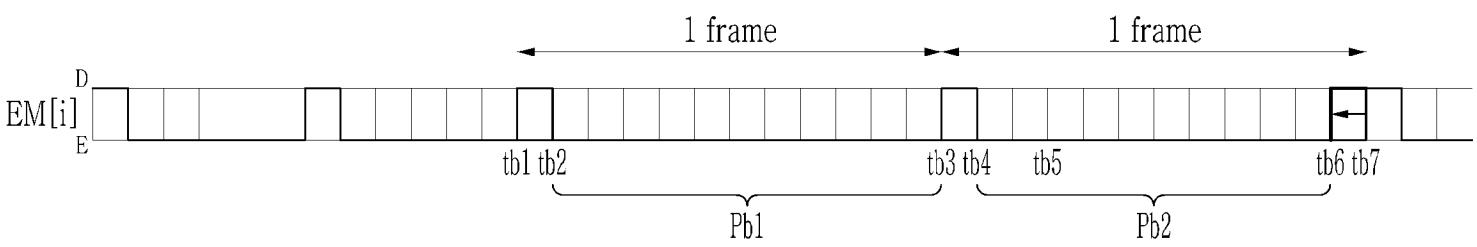
Figure 8C:
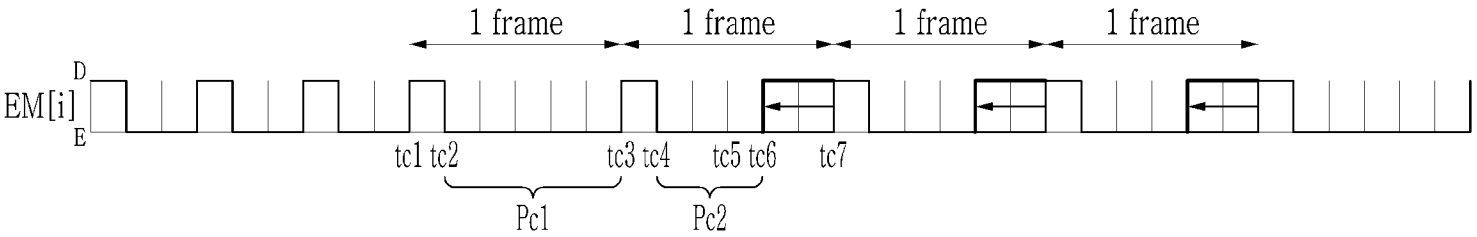

FIG. 8A to FIG. 8C illustrate timing diagrams showing an emission control signal applied to an $i^{th}$ emission control line depending on a change in the data enable signal DE.

FIG. 8A illustrates a case where a frame frequency is changed from f1 to f3. In a first frame period after the frame frequency is changed from f1 to f3, the emission control signal EM[i] is changed to a disable level D at ta1, and then the emission control signal is changed to an enable level E at ta2. In addition, the emission control signal is changed to the disable level D at ta3, and a new frame with the frame frequency of f3 is started. Herein, a time span during which the emission control signal maintains the enable level E is Pa1. Conventionally, the emission control signal changed to the enable level E at ta4, and a time span during which the emission control signal is maintained at the enable level E until the emission control signal is changed to the disable level D at ta7 was identical to a time span of Pa1. Accordingly, there is a problem in that there is a difference in luminance between frames when the frame frequency is changed.

However, in an embodiment of the invention, the emission control signal is changed to the enable level E at ta4 and then to the disable level D at ta6. Herein, a time span during which the emission control signal maintains the enable level E is Pa2, and a length of Pa2 is shorter than that of Pa1. That is, within a same time span, the difference in luminance between frames may be reduced by controlling a pulse width of the emission control signal EM with the control signal CONT3 in order to reduce a difference between a length of the non-emission period before a change of the frame frequency and a length of the non-emission period after a change of the frame frequency.

In the above, it has been described that the emission control signal is changed to the enable level E at ta4 and to the disable level D at ta6, but the emission control signal may be changed to the enable level E at ta5 and to the disable level D at ta7. However, as described above, since a time for counting the blank period of the frame period during which the frame frequency is changed is desired, the emission period may not be adjusted from the frame period during which the frame frequency is changed from f1 to f3, and there may be latency of at least one frame.

FIG. 8B illustrates a case where the frame frequency is changed from f2 to f3. In a first frame period after the frame frequency is changed from f2 to f3, the emission control signal is changed to a disable level D at tb1, and then the emission control signal is changed to an enable level E at tb2. In addition, the emission control signal is changed to the disable level D at tb3, and a new frame with the frame frequency of f3 is started. Herein, a time span during which the emission control signal maintains the enable level E is Pb1. Conventionally, the emission control signal changed to the enable level E at tb4, and a time span during which the emission control signal is maintained at the enable level E until the emission control signal is changed to the disable level D at tb7 was identical to a time span of Pb1.

However, in an embodiment of the invention, the emission control signal is changed to the enable level E at tb4 and then to the disable level D at tb6. Herein, a time span during which the emission control signal maintains the enable level E is Pb2, and a length of Pb2 is shorter than that of Pb1. Accordingly, the length of the non-emission period before the change of the frame frequency and the length of the non-emission period after the change of the frame frequency are identically maintained within the same time span.

In the above, it has been described that the emission control signal is changed to the enable level E at tb4 and to the disable level D at tb6, but the emission control signal may be changed to the enable level E at tb5 and to the disable level D at tb7. However, as described above, since a time for counting the blank period of the frame period during which the frame frequency is changed is desired, the emission period may not be adjusted from the frame period during which the frame frequency is changed from f2 to f3, and there may be latency of at least one frame.

FIG. 8C illustrates a case where the frame frequency is changed from f1 to f2. In a first frame period after the frame frequency is changed from f1 to f2, the emission control signal is changed to a disable level D at tc1, and then the emission control signal is changed to an enable level E at tc2. In addition, the emission control signal is changed to the disable level D at tc3, and a new frame with the frame frequency of f2 is started. Herein, a time span during which the emission control signal maintains the enable level E is Pc1. Conventionally, the emission control signal is changed to the enable level E at tc4, and a time span during which the emission control signal is maintained at the enable level E until the emission control signal is changed to the disable level D at tc7 was identical to a time span of Pc1.

However, in an embodiment of the invention, after the emission control signal is changed to the enable level E at tc4 and then to the disable level D at tc6. Herein, a time span during which the emission control signal maintains the enable level E is Pc2, and a length of Pc2 is shorter than that of Pc1. Accordingly, the length of the non-emission period before the change of the frame frequency and the length of the non-emission period after the change of the frame frequency are identically maintained within the same time span.

In the above, it has been described that the emission control signal is changed to the enable level E at tc4 and to the disable level D at tc6, but the emission control signal may be changed to the enable level E at tc5 and to the disable level D at tc7. However, as described above, since a time for counting the blank period of the frame period during which the frame frequency is changed is desired, the emission period may not be adjusted from the frame period during which the frame frequency is changed from f1 to f2, and there may be latency of at least one frame.

As illustrated in FIG. 8A to FIG. 8C, when a first frame, a second frame, and a third frame are consecutive frames and a frame frequency of the second frame and the third frame is lower than a frame frequency of the first frame, that is, a blank period of the data enable signal DE when image signals of the second frame and the third frame are inputted is longer than a blank period of the data enable signal DE when an image signal of the first frame is inputted, a non-emission period of the third frame may be increased. There is an effect that a flicker phenomenon is reduced because a difference in luminance between frames is reduced by the reduced non-emission period.

Figure 9:
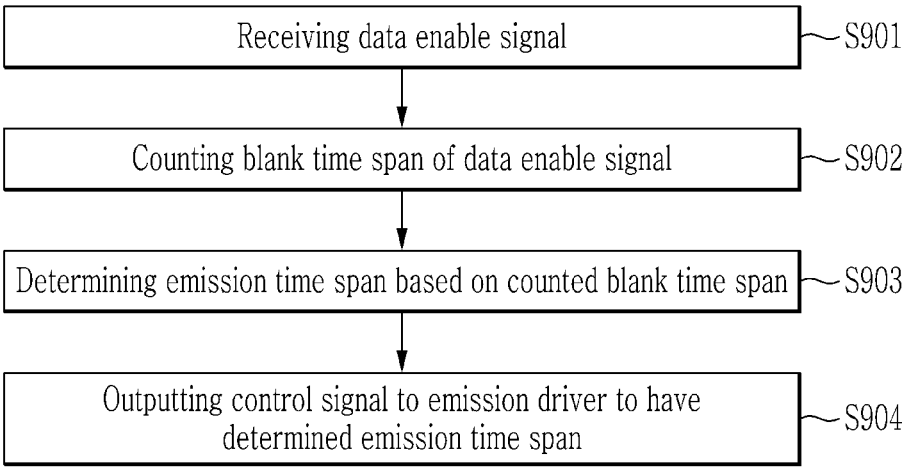
FIG. 9 illustrates a flowchart schematically showing an embodiment of a method of adjusting an emission period of a display device.

FIG. 9 illustrates a flowchart schematically showing an embodiment of a method of adjusting an emission period of a display device.

The counter 310 receives the data enable signal DE from the application processor 160 (S901). The counter 310 may further receive a main clock signal MCLK from the application processor 160.

The counter 310 counts a blank time span of the received data enable signal DE (S902). The counting unit 310 may determine a length of the blank time span by counting the clock signal CLK. The clock signal CLK may be a main clock signal MCLK supplied from the application processor 160, may be an internal clock signal generated based on the main clock signal MCLK, or may be a clock signal generated by an oscillator included in the signal controller 150.

The emission period adjuster 330 determines the emission time span based on the counted blank time span (S903). When the blank time span of a current frame is longer than the blank time span of a previous frame, the emission period adjuster 330 may further reduce the emission time span of the next frame compared to the emission time span of the current frame.

The emission period adjuster 330 outputs a control signal to the emission driver to have the determined emission time span (S904). In this case, a time when a previous frame emits light and a time when a next frame emits light for a same time may be substantially the same in a plurality of pixels.

The operations constituting the method according to the invention may be performed in an appropriate order unless explicitly stated or contradicted by the order. The invention is not necessarily limited to the described order of the operations. In the invention, use of all examples or illustrative terms (e.g., etc.) is merely for describing the invention in detail, and thus the scope of the invention is not limited thereto. In addition, a person of ordinary skill in the art may recognize that various modifications, combinations, and changes may be made within the scope of the claims or their equivalents.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display unit which includes pixels;

an emission driver which applies an emission control signal such that the pixels emit light; and a signal controller which determines a length of a blank period other than an active period during which an image signal is inputted by receiving a data enable signal from an external graphics source and generates a control signal for controlling the emission driver such that the pixels emit light during an emission period which is variable corresponding to the length of the blank period, wherein the signal controller includes a counter for determining the length of the blank period of the data enable signal, and when the counter determines that the blank period of a current frame is longer than the blank period of a previous frame, the pixels emitting light by an emission control signal having a changed pulse width in a next frame have a non-emission period which is longer than a non-emission period in the current frame.

2. The display device of claim 1, wherein the signal controller includes a counter for determining the length of the blank period of the data enable signal.

3. The display device of claim 2, wherein the counter determines the length of the blank period using a main clock signal which is inputted from the external graphics source.

4. The display device of claim 3, wherein the signal controller further includes an emission period adjuster for generating the control signal for controlling a pulse width of the emission control signal depending on a change in the length of the blank period.

5. The display device of claim 4, wherein the counter outputs information related to the length of the blank period to the emission period adjuster.

6. The display device of claim 5, further comprising:

a memory which includes information related to the emission period corresponding to the length of the blank period.

7. The display device of claim 6, wherein the emission period adjuster reads the information related to the emission period corresponding to the length of the blank period from the memory, and generates the control signal such that the pulse width of the emission control signal is changed based on the information related to the emission period.

8. The display device of claim 5, wherein the emission period adjuster generates the control signal such that the pulse width of the emission control signal is changed depending on the length of the blank period.

9. The display device of claim 1, wherein a start of the emission period of the next frame is delayed or an end of the emission period is advanced.

10. A driving method of a display device, the driving method comprising:

receiving a data enable signal from an external graphics source;

determining a length of a blank period other than an active period during which an image signal is inputted from the external graphics source using the data enable signal; and generating a control signal for controlling an emission driver for applying an emission control signal such that pixels included in a display unit emit light during an emission period which is variable corresponding to the length of the blank period, wherein the generating the control signal includes, when it is determined that the blank period of a current frame is longer than the blank period of a previous frame, generating the control signal such that the pixels emitting light by an emission control signal having a changed pulse width in a next frame to have a non-emission period which is longer than a non-emission period in the current frame.

11. The driving method of claim 10, wherein the determining the length of the blank period includes determining the length of the blank period using a main clock signal which is inputted from the external graphics source.

12. The driving method of claim 11, wherein the generating the control signal includes generating the control signal such that a pulse width of the emission control signal is changed depending on a change in the length of the blank period.

13. The driving method of claim 12, wherein the generating the control signal includes:

reading information related to the emission period from a memory in which the information related to the emission period corresponding to the length of the blank period is stored; and generating the control signal such that the pulse width of the emission control signal is changed based on the information on the emission period.

14. The driving method of claim 10, wherein a start of the emission period of the next frame is delayed or an end of the emission period is advanced.

15. A system comprising:

an application processor which outputs data enable signals with different blank periods depending on a variable frame mode; and a display device which includes a display unit including pixels and a signal controller for controlling the display unit such that a period during which the pixels emit light is variable depending on the blank periods, wherein the signal controller includes a counter which determines lengths of the blank periods; and when the counter determines that the blank period of a current frame is longer than the blank period of a previous frame, the pixels emitting light by an emission control signal having a changed pulse width in a next frame have a non-emission period which is longer than a non-emission period in the current frame.

16. The system of claim 15, wherein the signal controller includes:

a counter which determines lengths of the blank periods;

an emission period adjuster which changes a pulse width of an emission control signal for controlling the display unit so that a period during which the pixels emit light is different depending on a change in the lengths of the blank periods; and a memory which includes information related to an emission period depending on the lengths of the blank periods.

17. The system of claim 15, wherein a start of the emission period of the next frame is delayed or an end of the emission period is advanced.

* * * * *